US011022366B2

(12) United States Patent
Minoru et al.

(10) Patent No.: US 11,022,366 B2
(45) Date of Patent: Jun. 1, 2021

(54) REFRIGERATOR

(71) Applicant: Samsung Electronics Co., Ltd, Suwon-si (KR)

(72) Inventors: Ohtsubo Minoru, Kanagawa (JP); Yoshida Jyunji, Kanagawa (JP); Kan Kentaro, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/268,379

(22) Filed: Feb. 5, 2019

(65) Prior Publication Data

US 2019/0242640 A1 Aug. 8, 2019

(30) Foreign Application Priority Data

Feb. 5, 2018 (JP) ..... 2018-018649
Sep. 5, 2018 (JP) ..... 2018-165759
Jan. 4, 2019 (KR) ..... 10-2019-0001142

(51) Int. Cl.
*F25D 25/02* (2006.01)
*A47B 88/457* (2017.01)
(Continued)

(52) U.S. Cl.
CPC ..... *F25D 25/025* (2013.01); *A47B 88/453* (2017.01); *A47B 88/457* (2017.01);
(Continued)

(58) Field of Classification Search
CPC .. F25D 25/025; F25D 23/067; F25D 2325/00; F25D 23/021; A47B 88/453;
(Continued)

(56) References Cited

U.S. PATENT DOCUMENTS 3,159,933 A * 12/1964 Mulch ..... G03B 23/04 353/122
4,828,344 A * 5/1989 Omata ..... A47B 88/467 312/319.1
(Continued)

FOREIGN PATENT DOCUMENTS

CN 102538363 A 7/2012
CN 106196870 A 12/2016
(Continued)

OTHER PUBLICATIONS

ISA/KR, International Search Report and Written Opinion of the International Searching Authority, International Application No. PCT/KR2019/001428, dated May 28, 2019, 12 pages.
(Continued)

*Primary Examiner* — Hiwot E Tefera

(57) ABSTRACT

Disclosed herein is a refrigerator having a structure to be assembled in the manufacturing of the refrigerator and configured to reduce a load applied to a drive unit driving a rail although a position of the rail is displaced with respect to a refrigerator body. The refrigerator includes a body, a storage compartment disposed inside the body and provided with an opening, a drawer configured to open and close the opening of the storage compartment, and a sliding apparatus configured to slidably support the drawer against the storage compartment and the sliding apparatus includes a first rail installed on an inner wall of the storage compartment, a second rail installed on the drawer and configured to be slidable with respect to the first rail, and a drive unit installed on the first rail and configured to provide a driving force to slide the second rail.

18 Claims, 10 Drawing Sheets

(51) Int. Cl.
*A47B 88/453* (2017.01)
*F25D 23/06* (2006.01)

(52) U.S. Cl.
CPC ..... *F25D 23/067* (2013.01); *A47B 2210/175* (2013.01); *F25D 2325/00* (2013.01)

(58) Field of Classification Search
CPC .... A47B 2210/0048; A47B 2210/0059; A47B 2210/0078; A47B 2210/175; A47B 88/457
USPC ..... 312/319.5, 319.8, 331, 330.1, 334.1
See application file for complete search history.

(56) References Cited

U.S. PATENT DOCUMENTS 6,336,247 B1 * 1/2002 Schnoor ..... E05D 15/0634 16/105
7,184,266 B1 * 2/2007 Chen ..... B60R 11/0235 312/196
8,708,435 B2 * 4/2014 Johnson ..... A47B 88/70 312/330.1
9,788,655 B2 * 10/2017 Chen ..... F16C 29/008
10,413,064 B1 * 9/2019 Lu ..... A47B 88/50
2001/0013745 A1 * 8/2001 Fulterer ..... A47B 88/457 312/319.5
2003/0122459 A1 * 7/2003 Huber ..... A47B 88/457 312/319.6
2003/0122519 A1 * 7/2003 Huber ..... A47B 88/457 318/646
2004/0100169 A1 * 5/2004 Huber ..... A47B 88/457 312/319.5
2004/0104649 A1 * 6/2004 Muller ..... A47B 88/467 312/333
2006/0261775 A1 * 11/2006 Huber ..... A47B 88/457 318/646
2007/0170828 A1 * 7/2007 Hoshide ..... A47B 88/457 312/319.5
2008/0191591 A1 * 8/2008 Blucher ..... A47B 88/457 312/319.1
2008/0224584 A1 * 9/2008 Weber ..... A47B 88/493 312/334.27
2008/0315739 A1 * 12/2008 Hirano ..... F24C 15/18 312/330.1
2009/0045713 A1 * 2/2009 Kunkle ..... A47B 88/447 312/402
2009/0322196 A1 * 12/2009 Park ..... A47B 88/447 312/404
2010/0219727 A1 * 9/2010 Aguilar Ante ..... A47B 88/40 312/319.1
2010/0237758 A1 * 9/2010 Gasser ..... A47B 88/457 312/319.1
2010/0263402 A1 10/2010 Lee
2011/0037362 A1 * 2/2011 Park ..... A47B 88/467 312/319.1
2011/0050065 A1 3/2011 Lee et al.
2013/0154461 A1 * 6/2013 Bohle ..... E05F 15/614 312/319.6
2013/0270989 A1 10/2013 Park et al.
2014/0285081 A1 * 9/2014 Wu ..... G07F 9/10 312/334.1
2016/0040924 A1 2/2016 Jung
2016/0146533 A1 * 5/2016 Jung ..... A47B 88/463 312/405
2016/0174713 A1 * 6/2016 Dubina ..... F25D 25/025 312/334.8

FOREIGN PATENT DOCUMENTS

DE 102012111977 A1 * 6/2014 ..... A47B 88/483
EP 1 323 364 A1 7/2003
JP H05-113287 A 5/1993
KR 10-2010-0106686 A 10/2010
KR 10-2011-0026059 A 3/2011
KR 10-2013-0119272 A 10/2013
KR 10-2016-0019125 A 2/2016
WO WO-2015131778 A1 * 9/2015 ..... F25D 25/025

OTHER PUBLICATIONS

Supplementary European Search Report dated Dec. 16, 2020 in connection with European Patent Application No. 19 74 6966, 8 pages.

* cited by examiner

REFRIGERATOR

CROSS-REFERENCE TO RELATED APPLICATIONS

This application is based on and claims priority under 35 U.S.C. § 119 to Korean Patent Application No. 10-2019-0001142 filed on Jan. 4, 2019 in the Korean Intellectual Property Office, which claims the benefit of Japan Patent Application No. 2018-018649 filed on Feb. 5, 2018, and Japan Patent Application No. 2018-165759 filed on Sep. 5, 2018 in the Japan Intellectual Property Office, the disclosures of which are incorporated by reference herein in their entireties.

BACKGROUND

1. Field

The disclosure relates to a refrigerator.

2. Description of Related Art.

In a conventional manner, a refrigerator having a drawer has been used. For example, a patent document 1 discloses a refrigerator provided with a refrigerator body having a storage compartment, a drawer opening and closing the storage compartment, and a sliding apparatus sliding the drawer against the storage compartment in an opening and closing direction.

The sliding apparatus of the refrigerator disclosed in the patent document 1 is provided with a first rail installed on the refrigerator body and a second rail installed on the drawer. By a drive unit installed on the refrigerator body, the second rail is slid against the first rail in the opening and closing direction.

Accordingly, if the first rail and the drive unit are not installed with high precision at the time of manufacturing the refrigerator, the second rail presses the drive unit and an excessive load is applied to the drive unit. Therefore, the high precision assembly is used at the time of manufacturing the refrigerator.

Further, even if the first rail and the drive unit are assembled with the high precision, when the positional deviation occurs in the first rail due to the deterioration over time, the second rail presses the drive unit and an excessive load is applied to the drive unit.

In addition, the positional deviation of the first rail may also occur when the load applied to the drawer is changed in accordance with the increase or decrease in the amount of things (e.g., food) contained in the drawer.

SUMMARY

Therefore, it is an aspect of the disclosure to provide a refrigerator having a structure configured to be relatively easily assembled in the manufacturing of the refrigerator and configured to reduce a load applied to a drive unit driving a rail although a position of the rail is displaced with respect to a refrigerator body due to the deterioration over time or the deterioration caused by the change in a weight of things, which are stored in a drawer, in accordance with the increase or decrease in the amount of the things.

Additional aspects of the disclosure will be set forth in part in the description which follows and, in part, will be obvious from the description, or may be learned by practice of the disclosure.

In accordance with an aspect of the disclosure, a refrigerator including a body, a storage compartment disposed inside the body and provided with an opening, a drawer configured to open and close the opening of the storage compartment, and a sliding apparatus configured to slidably support the drawer against the storage compartment and the sliding apparatus includes a first rail installed on an inner wall of the storage compartment, a second rail installed on the drawer and configured to be slidable with respect to the first rail, and a drive unit installed on the first rail and configured to provide a driving force to slide the second rail.

The drive unit may be coupled to a lower surface of the first rail.

The drive unit may be spaced apart from the inner wall of the storage compartment.

The sliding apparatus may further include a power transmission unit configured to transmit a driving force of the drive unit to the second rail.

The drive unit may include a housing coupled to the lower surface of the first rail, a drive motor disposed inside the housing, and a drive gear disposed outside the housing and configured to transmit the driving force of the drive motor to the power transmission unit.

The first rail may include a first end disposed in a front portion of the storage compartment adjacent to the opening, and a second end disposed in a rear portion of the storage compartment, and the drive gear may be adjacent to the first end.

The power transmission unit may include a first rack gear installed on the second rail and configured to engage with the drive gear.

The power transmission unit may include at least one elastic member disposed between the first rail and the second rail to press the first rack gear against the drive gear.

The first rack gear may be coupled to the second rail to be relatively movable in a. direction perpendicular to a direction in which the drawer opens and closes the opening of the storage compartment.

The second rail may include a plurality of holes elongated in a direction in parallel with a direction in which the first rack gear moves relative to the second rail, and the first rack gear may include a plurality of screw members configured to pass through the plurality of holes and configured to be movable along the plurality of holes, respectively.

The plurality of holes may include a first hole and a second hole, and the first hole and the second hole may have different lengths in a direction in parallel with the direction the first rack gear moves relative to the second rail.

The drive unit may include a receiving portion recessed on an outer surface of the housing and configured to receive the drive gear therein, and a cap coupled to the housing to cover at least one part of the receiving portion.

The drive unit may further include a discharging portion configured to communicate with the receiving portion and extend to the lower side from the receiving portion.

The first rack gear may be disposed above the drive gear.

The sliding apparatus may further include an adjustment unit disposed in a rear side of the power transmission unit to adjust a moving distance of the second rail with respect to the first rail.

The adjustment unit may include a second rack gear installed on the first rail, a shaft rotatable supported by the second rail, and an adjustment gear provided both ends of the shaft and configured to engage with the second rack gear.

The second rack gear may be disposed above the adjustment gear.

The second rack gear may be disposed to be opposite to the first rack gear with respect to the adjustment gear.

The sliding apparatus may further include a slide rail disposed between the first rail and the second rail and configured to slide the second rail against the first rail.

The storage compartment may include a protruding portion formed such that a part of the inner wall of the storage compartment is protruded toward the opening, and the first rack gear may be disposed above the protruding portion inside the storage compartment.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
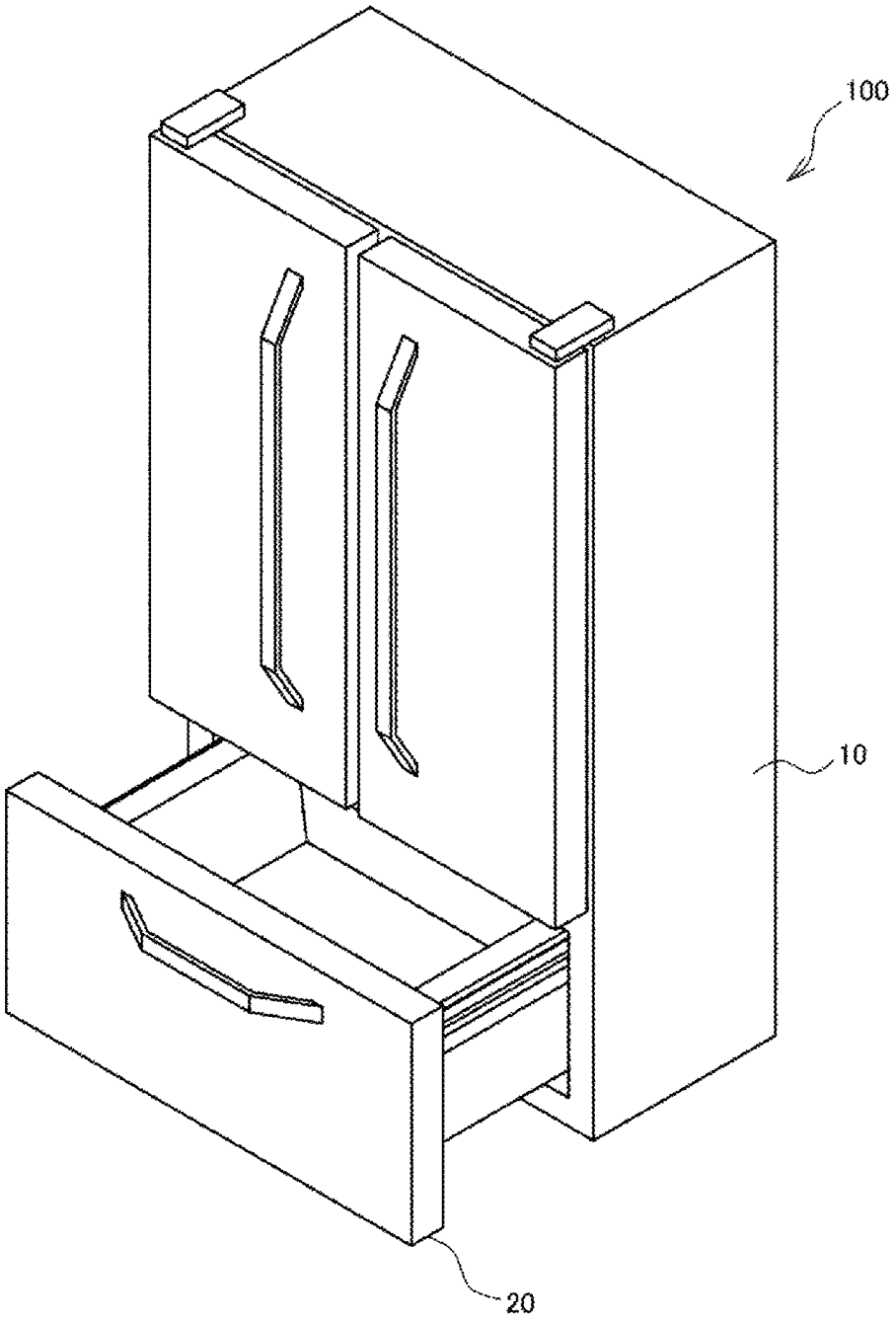
FIG. 1 illustrates a perspective view of a refrigerator according to one embodiment of the disclosure.

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure, and may be modified in various different ways at the time of filing of the present application to replace the embodiments and drawings of the disclosure.

Figure 2:
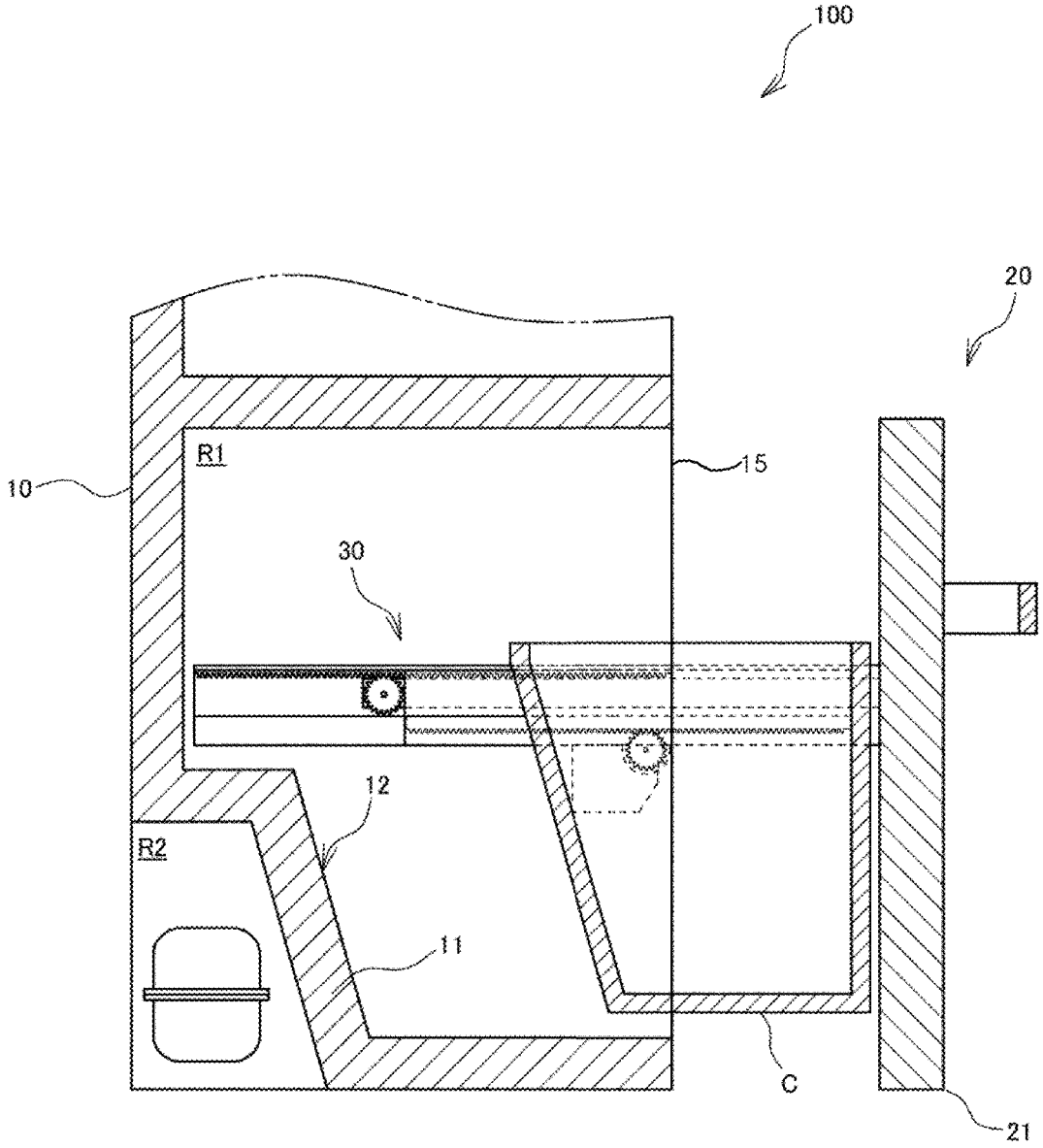
FIG. 2 illustrates a longitudinal section of a lower portion of the refrigerator according to one embodiment of the disclosure.

As illustrated in FIGS. 1 and 2, a refrigerator 100 according to one embodiment includes a refrigerator body 10, a storage compartment R1 provided inside the refrigerator body 10 and provided with an opening 15, a drawer 20 slidably coupled to the storage compartment R1 to open and close the opening 15, and a sliding apparatus 30 configured to movably support the drawer 20 against the storage compartment R1.

The refrigerator body 10 has a plurality of storage compartments other than the storage compartment R1, and a machine room R2, in which a device such as a compressor is provided, is provided at the rear of the storage compartment R1.

A protruding portion 12 protruding toward an opening direction (front) side is formed in an inner wall 11 which separates the storage compartment R1 from the machine room R2. Therefore, the storage compartment R1 is formed such that an upper area, on which the protruding portion 12 is not formed, is longer than a lower area, on which the protruding portion 12 is formed, along a direction in which the drawer is slide (hereinafter referred to as a first direction).

The drawer 20 has a door plate 21 blocking the opening 15 of the storage compartment R1.

Figure 3:
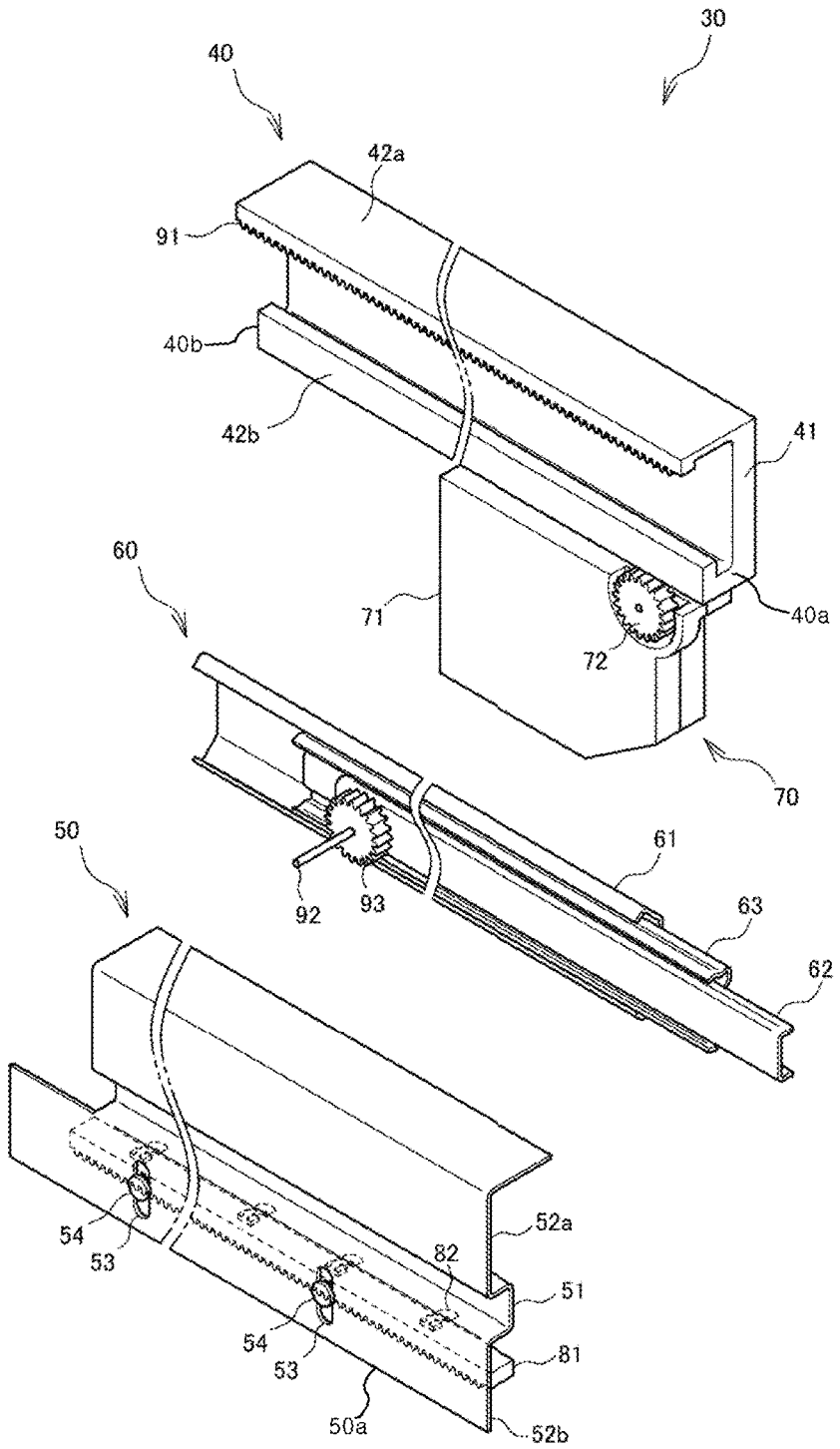
FIG. 3 illustrates an exploded perspective view of a sliding apparatus installed in the refrigerator according to one embodiment of the disclosure.
Figure 4:
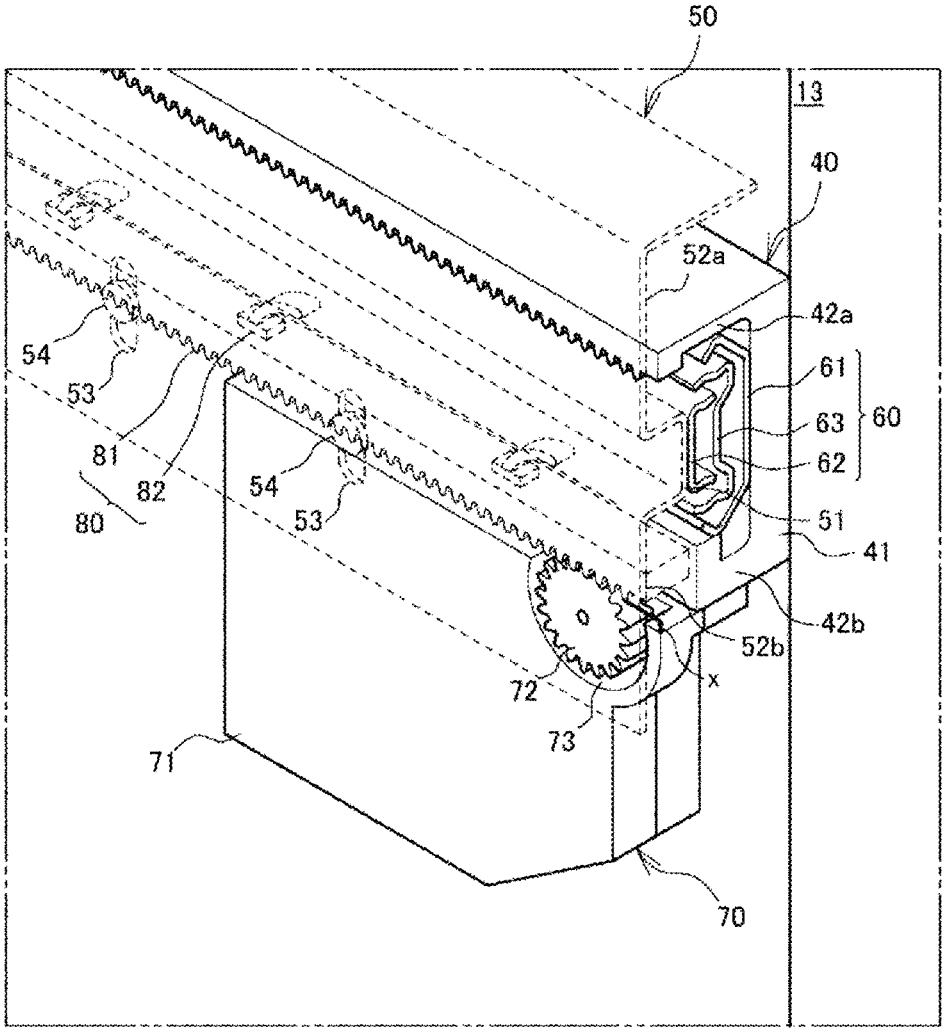
FIG. 4 illustrates a perspective view showing one side (an opening direction) end of the sliding apparatus installed in the refrigerator according to one embodiment of the disclosure.
Figure 5:
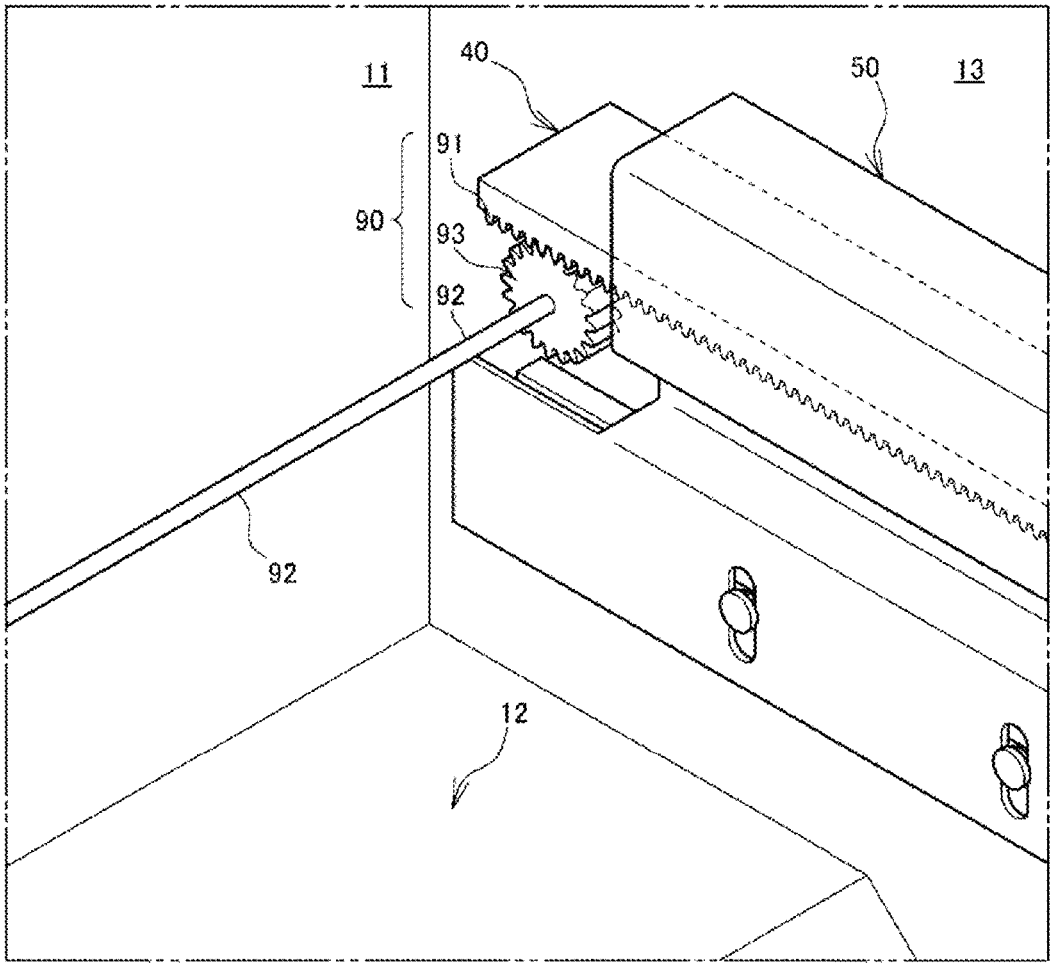
FIG. 5 illustrates a perspective view showing other side (a closing direction) end of the sliding apparatus installed in the refrigerator according to one embodiment of the disclosure.

As illustrated in FIGS. 3 to 5, the sliding apparatus 30 includes a pair of first rails 40 provided on respective side walls 13 of the storage compartment R1, a pair of second rails 50 provided on the door plate 21 of the drawer 20, a slide rail 60 disposed between the first rail 40 and the second rail 50 and configured to slide the second rail 50 against the first rail 40, a drive unit 70 installed on the first rail 40 and a power transmission device 80 configured to transmit a power of the drive unit 70 to the second rail 50.

The first rail 40 is fixed to both side walls 13 of the storage compartment R1 and elongated in the first direction. The first rail 40 is installed in the upper area of the storage compartment R1. One end 40*b* of the rear side of the first rail 40 is disposed above the protruding portion 12.

The first rail 40 includes a fixed portion 41 fixed to the side wall 13 of the storage compartment R1 and a pair of supporting portions 42 extending from an upper side and a lower side of the fixed portion 41 to a direction perpendicular to the side wall 13.

The drive unit 70 is installed in the first rail 40.

The drive unit 70 includes a housing 71 provided in the first rail 40, a drive motor (not shown) provided inside the housing 71, and transmission gears (not shown) configured to transmit a torque of the drive motor (not shown).

The housing 71 is provided on a lower surface of a lower supporting portion 42*b* of the first rail 40.

Inside the housing 71, the drive motor (not shown) and the transmission gears (not shown) configured to transmit a torque of the drive motor (not shown) are installed.

A drive gear 72 driving the second rails 50 by receiving the torque from the transmission gears (not shown) is installed on an outer surface of the housing 71. The drive gear 72 is installed in a concave portion 73 formed on the outer surface of the housing 71 and disposed at one end portion 40*a* on the front side of the first rail 40. The drive gear 72 is disposed at a position adjacent to the opening 15 of the storage compartment R1.

The housing 71 is connected to the storage compartment R1 through the first rail 40 but the housing 71 itself is not directly coupled to the storage compartment R1.

The housing 71 is spaced apart from the side wall 13 of the storage compartment R1 and thus spaced apart from the refrigerator body 10 in which a dimension deviation is likely to occur during manufacture of the refrigerator.

According to one embodiment, a structure in which the housing 71 is manufactured separately from the first rail 40 and then installed on the first rail 40 has been described. Alternatively, a structure in which the housing 71 and the first rail 40 are integrally formed may be applied.

Although not shown, a concave receiving portion is formed on an inner surface of the storage compartment R1, particularly, on an inner surface of the side wall 13 that is adjacent to the housing 71 of the storage compartment R1. A processor (not shown) including a substrate for controlling the drive motor, which is placed in the housing 71, may be placed in the receiving portion, and thus it is easy to perform a wiring process that is to be connected to the motor.

The second rails 50 are installed to extend in parallel with each other from both sides of the back surface (rear surface) of the door plate 21. Between the two second rails 50, a storage case C storing products is supported.

The second rail 50 is formed by bending a long plate member by a plurality of times in a longitudinal direction thereof. Particularly, the second rail 50 is bent such that a center line 51, which faces the first rail 40, protrudes toward the first rail 40. The center line 51 protrudes further toward the first rail 40 than an upper line 52*a* and a lower line 52*b*.

A driving rack gear 81 forming the power transmission device 80 described later is provided on the lower side line 52*b* of the second rail 50. In a state in which the driving rack gear 81 is installed in the second rail 50, the driving rack gear 81 is disposed such that teeth of the driving rack gear 81 are directed to the lower side.

The driving rack gear 81 is engaged with the drive gear 72 forming the drive unit 70 provided on the first rail 40 and thus the power of the drive motor (not shown) may be transmitted to the second rail 50.

The driving rack gear 81 is installed on the second rail 50 such that a distance between a top land of the teeth of the driving rack gear 81 and a top land of the teeth of the drive gear 72 is 5 mm or less. Accordingly, it is possible to prevent an accident in which the finger is stuck between the driving rack gear 81 and the drive gear 72.

The driving rack gear 81 also includes screw members 54 passing through a plurality of holes 53 formed in the lower line 52*b* of the second rail 50.

Each of the plurality of holes 53 extends in a direction intersecting with the first direction (perpendicular to the first direction in this embodiment). Each of the screw members 54 is configured to be slidable with respect to the plurality of holes 53. Accordingly, the driving rack gear 81 may slide along the plurality of holes 53 in the direction intersecting (perpendicular to) the first direction.

A plurality of elastic members 82 is provided on one surface of the driving rack gear 81 facing a lower step formed by the center line 51 and the lower line 52*b* of the second rail 50. The driving rack gear 81 is pressed against the drive gear 72 by the elastic member 82.

The power transmission device 80 includes the driving rack gear 81 and the plurality of elastic members 82.

The slide rail 60 includes an outer member 61 fixed to the first rail 40, an inner member 62 fixed to the second rail 50, and a middle member 63 disposed between the outer member 61 and the inner member 62.

The middle member 63 is configured to be slidable by a ball 64 provided between the outer member 61 and the inner member 62.

The outer member 61 has a length substantially equal to a length of the first rail 40 in the first direction and is fixed between the supporting portions 42*a* and 42*b* of the first rail 40 by being inserted therebetween.

The inner member 62 has a length substantially equal to the length of the first rail 40 in the first direction and is fixed to the center line 51 of the second rail 50. One end of the rear side of the inner member 62 protrudes further toward the rear of the storage chamber R1 than the second rail 50.

Since the outer member 61 is a member fixed to the first rail 40 without being slidable on the first rail 40, it may be assumed that the outer member 61 is contained in the first rail 40.

In the same manner, since the inner member 62 is a member that is fixed to the second rail 50 without being slidable on the second rail 50, it may be assumed that the inner member 62 is contained in the second rail 50.

That is, the first rail 40 represents a member that does not slide against the refrigerator body 10 among the members forming the sliding apparatus 30, and the second rail 50 represents a member that does not slide against the drawer 20 forming the sliding apparatus 30.

The ball 64 corresponds to a rolling mechanism 60*a* and the rolling mechanism 60*a* is configured to smoothly slide the second rail 50 against the first rail 40.

The sliding apparatus 30 further includes an adjustment unit 90 configured to adjust a movement distance, which the respective second rails 50 slides against the respective first rails 40, to be equal to each other.

The adjustment unit 90 includes an adjustment rack gear 91 provided on each of the first rails 40, a shaft 92 supported by both second rails 50, and an adjustment gear 93 fixed to both ends of the shaft 92 and engaged with the adjustment rack gear 91.

The adjustment rack gear 91 is provided on the upper supporting portion 42*a* of the first rail 40. In a state in which the adjustment rack gear 91 is installed in the first rail 40, the adjustment rack gear 91 is disposed such that teeth of the adjustment rack gear 91 are directed to the lower side.

The shaft 92 is rotatably supported on each of the rear ends of the inner member 62 protruding from the second rails 50 toward the rear of the storage compartment R1.

The adjustment gear 93 is fixed to the shaft 92 so that the adjustment gear 93 is not rotatable about the shaft 92. Each of the adjustment rack gears 91 are configured to engage with the adjustment gear 93 fixed to both ends of the shaft 92.

The teeth of both adjustment rack gears 91 and the teeth of both adjustment gears 93 are arranged so as to have the same pitch. Accordingly, when the shaft 92 is rotated about the inner member 62, a movement speed of the adjustment gear 93 engaged with the one adjustment rack gear 91 is substantially identical to a movement speed of the adjustment gear 93 engaged with the other adjustment rack gear 91.

The adjustment rack gear 91 is arranged in parallel with the driving rack gear 81 in the vertical direction. Therefore, the top land of the teeth of the adjustment rack gear 91 and the top land of the teeth of the driving rack gear 81 are directed to the lower side.

The adjustment gear 93 is disposed between the upper surface of the driving rack gear 81, which is opposite to the surface on which the teeth of the driving rack gear 81 are formed, and the top land of the teeth of the adjustment rack gear 91. The adjustment gear 93 is configured to rotate and move on the upper surface of the driving rack gear 81.

One end of the adjustment rack gear 91 and one end of the driving rack gear 81 extend in parallel to each other to be disposed above the protruding portion 12 of the storage compartment R1.

When the second rail 50 provided on the drawer 20 is engaged with the first rail 40 provided in the storage compartment R1, the lower line 52*b* of the second rail 50 faces the entire drive gear 72. That is, the lower end portion 50*a* of the second rail 50 extends further downward than the lower end portion of the top land of the teeth of the drive gear 72. Since the drive gear 72 is covered by the second rail 50, it is possible to prevent the injury caused by the user's fingers being caught.

Next, a sliding operation of the drawer 20 of the refrigerator 100 according to one embodiment will be described.

When an open signal is received from an operation portion (not shown) provided on the front side of the drawer 20, in a state in which the drawer 20 completely closes the storage room R1, the drive motor rotates. The torque of the drive motor is transmitted to the drive gear 72 via the transmission gears, and the torque transmitted to the drive gear 72 is transmitted to the second rail 50 through the driving rack gear 81 engaged with the drive gear 72. Accordingly, the drawer 20 is moved in the first direction with respect to the storage compartment R1 to open the storage compartment R1. When the drawer 20 fully opens the storage compartment R1, a detection device (not shown) such as a position sensor detects the opening and when a signal generated by the detection device is transmitted to the processor configured to control the drive motor, the drive motor is stopped by the processor.

When a close signal is received, in a state in which the drawer 20 completely opens the storage room R1, the drive motor rotates. The torque of the drive motor is transmitted to the drive gear 72 via the transmission gears and the torque transmitted to the drive gear 72 is transmitted to the second rail 50 through the driving rack gear 81 engaged with the drive gear 72. Accordingly, the drawer 20 is moved with respect to the storage compartment R1 in a second direction opposite to the first direction. When the drawer 20 fully closes the storage compartment R1, a detection device (not shown) such as a position sensor detects the closing and when a signal generated by the detection device is transmitted to the processor configured to control the drive motor, the drive motor is stopped by the processor.

According to the configuration described above, during the drawer 20 opens and closes the storage compartment R1, a movement speed of one side second rail 50 about the first rail 40 is adjusted to be substantially identical to a movement speed of the other side second rail 50 about the first rail 40 by the adjustment unit 90, and thus unbalance in both lateral directions (left and right side) of the drawer 20 is reduced.

When the drawer 20 is moved in the first direction to open the storage compartment R1, the drawer 20 is inclined the front downward by its own weight. At this time, an inclination angle of the drawer 20 increases as the drawer 20 becomes a fully opened state from a fully closed state of the storage compartment R1. Due to the inclination of the drawer 20, the second rail 50, particularly, the front end side of the second rail 50 adjacent to the opening 15 is inclined downward about the first rail 40. Accordingly, the driving rack gear 81 installed in the second rail 50 is moved in a direction of pressing the drive gear 72 and an overload condition occurs by the displacement of the engaging position between gears. Therefore, a noise may occur and the driving rack gear 81 or the drive gear 72 may be damaged.

However, according to the above configuration, since the elastic member 82 is bent by a pressing force, which is equal to or greater than a certain level, to absorb the movement of the driving rack gear 81 caused by the inclination of the drawer 20, the engagement between the driving rack gear 81 and the drive gear 72 is constantly maintained and thus the drive gear 72 is not overloaded more than necessary.

The first rail 40 is disposed above the protruding portion 12 of the storage compartment R1 and the one end of the driving rack gear 81 installed on the first rail 40 extends to be disposed above the protruding portion 12. Further, the drive gear 72 engaged with the driving rack gear 81 is disposed adjacent to the opening 15 of the storage compartment R1. This makes it possible to secure a long sliding distance of the drawer 20 with respect to the storage compartment R1.

Figure 7:
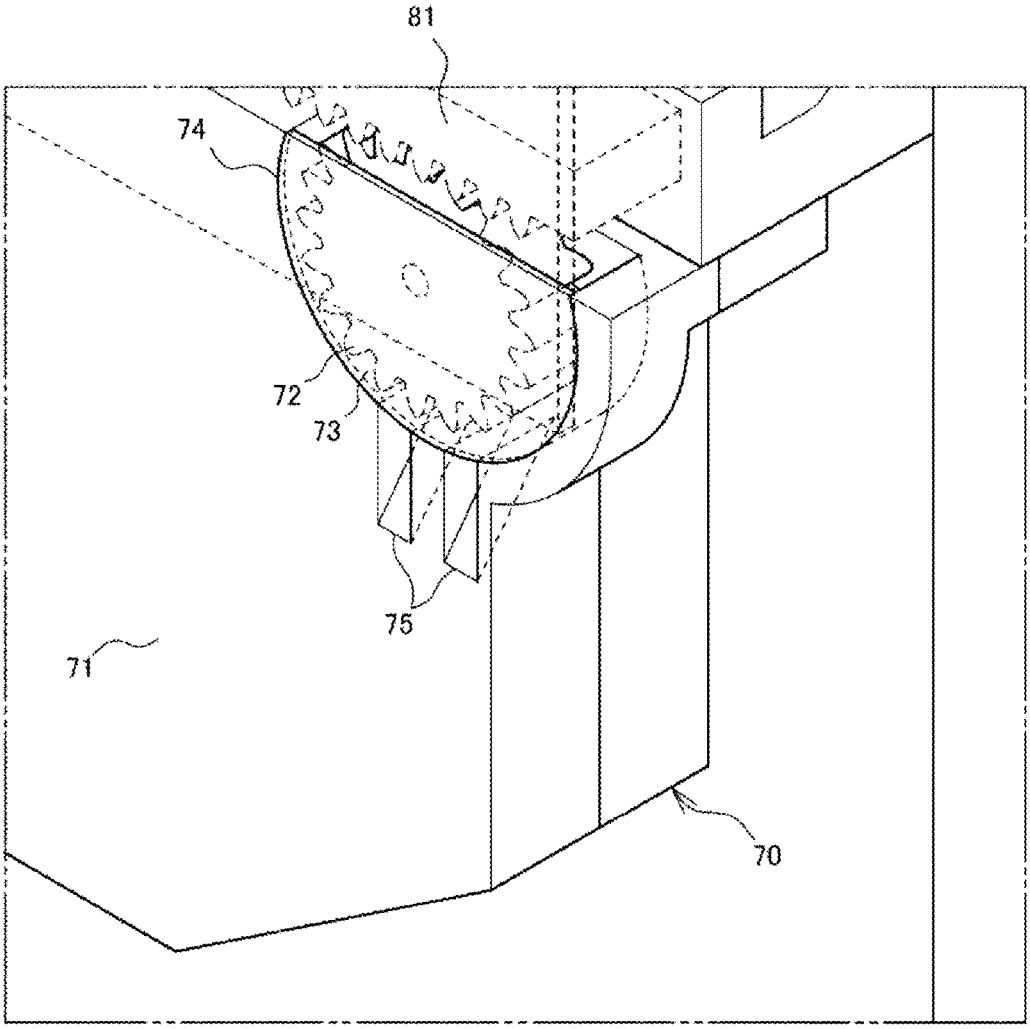
FIG. 7 illustrates a perspective view of a modified embodiment of a housing of the drive unit according to one embodiment of the disclosure.

FIG. 7 illustrates a perspective view of a modified embodiment of a housing of the drive unit.

A housing 71 shown in FIG. 7 has a groove communicating with a concave portion 73 and extending downward from the concave portion 73, and a cap 74 being coupled to the housing 71 to cover at least one part of the concave portion 73.

By blocking the concave portion 73 with the cap 74, only the teeth, which is engaged with a driving rack gear 81 among a drive gear 72, is exposed to the outside of the housing 71. A discharging portion 75 configured to allow the concave portion 73 to communicate with the outside of the housing 71 is formed in a lower portion of the cap 74.

According to the above-described structure, since the gear system including the drive gear 72 is hardly exposed to the outside of the housing 71, it is possible to prevent injuries that may occur when the user's fingers are caught. In addition, the foreign substance introduced into the concave portion 73 is discharged from the discharging portion 75, and thus it is possible to prevent the drive unit 70 from being abnormally operated or damaged by the foreign substance.

Figure 8:
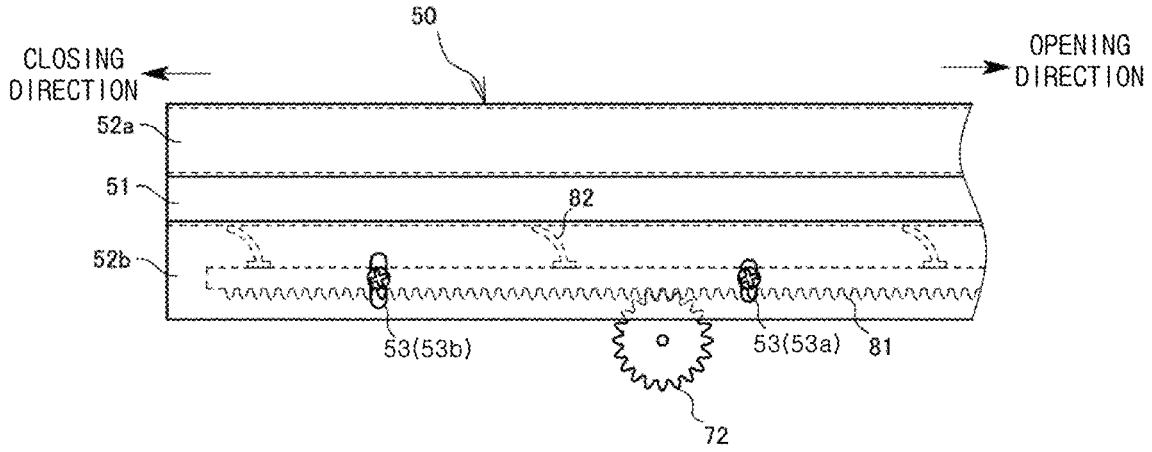
FIG. 8 illustrates a side view of a modified embodiment of a power transmission unit according to one embodiment of the disclosure.

FIG. 8 illustrates a side view of a modified embodiment of a power transmission unit.

In the second rail 50 as shown in FIG. 8, a plurality of holes 53 configured to couple the driving rack gear 81 to the second rail 50 includes a first hole 53*a* and a second hole 53*b*, wherein the first hole 53*a* and the second hole 53*b* have different lengths in a direction in parallel with a direction the driving rack gear 81 moves relative to the second rail 50.

The first hole 53*a* is disposed adjacent to the opening 15 of the storage compartment R1, and the second hole 53*b* is disposed adjacent to the rear side of the storage compartment R1. The length of the second hole 53*b* is longer than the length of the first hole 53*a*.

As mentioned above, when the drawer 20 is taken out from the storage compartment R1, the door plate 21 side is inclined the front downward by the weight of the drawer 20. Due to the inclination of the drawer 20, the second rail 50 is inclined with respect to the first rail 40 and thus the driving rack gear 81 installed on the second rail 50 moves in the direction of pressing the drive gear 72. As the drawer 20 is more taken out from the storage compartment R1, the driving rack gear 81 more moves in the direction of pressing the drive gear 72. However, by using the above mentioned configuration, it is possible to secure a sufficient long movable range of the driving rack gear 81 so as to relieve the load applied to the drive gear 72 when the drawer 20 is taken out by a relatively long distance. In addition, when the drawer 20 is taken out by a relatively short distance, it is possible to secure a small movable range of the driving rack gear 81 so as to maintain the engagement between the driving rack gear 81 and the drive gear 72.

In another embodiment, the drive gear 72 is provided so as to be movable in a direction, in which the drive gear 72 is in contact with and separated from the driving rack gear 81 (in a direction perpendicular to the first direction), with respect to the housing 71. The drive unit 70 may include an elastic member (not shown) pressing the drive gear 72 to the driving rack gear 81.

In this case, the housing 71 includes a hole (not shown) through which a rotary shaft (not shown) of the drive gear 72 passes, and the hole is elongated in the direction in which the drive gear 72 is in contact with and separated from the driving rack gear 81. The rotary shaft is configured to be movable along the hole, and the rotary shaft itself may have elasticity.

A structure, in which an entire gear system (not shown) including a drive motor installed inside the housing 71 is pressed upward by the elastic member and the drive gear 72 is pressed by the driving rack gear 81 through the rotary shaft of the drive gear 72 contained in the gear system, may be applicable.

Figure 6:
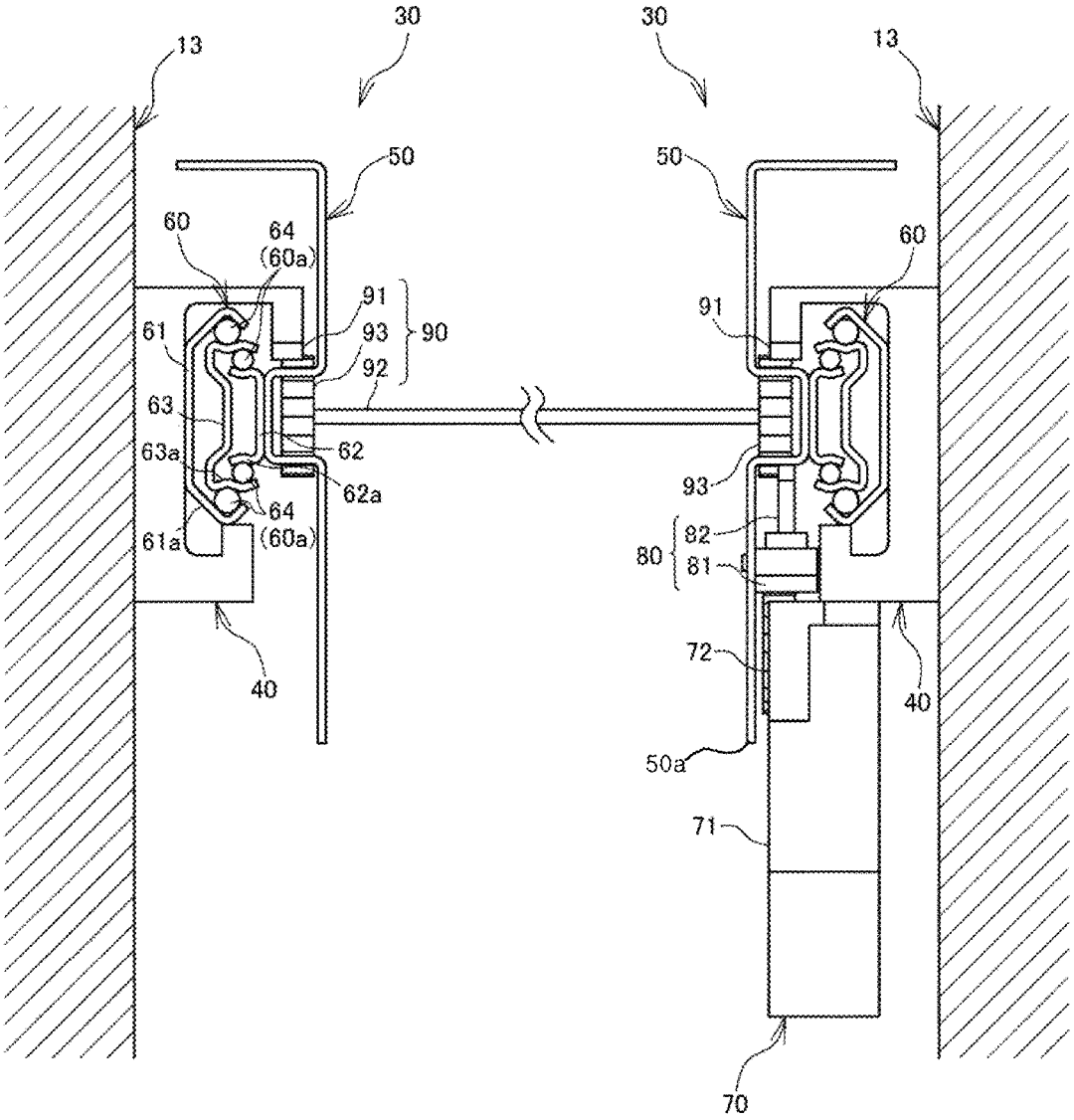
FIG. 6 illustrates a view showing the sliding apparatus installed on both side walls of the refrigerator according to one embodiment of the disclosure.

In addition, as illustrated in FIG. 6, the slide rail 60 according to one embodiment has a structure in which each member 61, 62 and 63, which are manufactured by bending a long plate member to have an approximately "U" shaped cross-section, are combined with each other.

Side edges 61*a*, 62*a* and 63*a* extending in the longitudinal direction of the respective members 61, 62 and 63 are arranged such that the side edge 63*a* of the middle member 63 is disposed outside the side edge 62*a* of the inner member 62 and the side edge 61*a* of the outer member 61 is disposed outside the side edge 63*a* of the middle member 63.

Further, a ball 64 may be disposed between the side edge 62*a* of the inner member 62 and the side edge 63*a* of the middle member 63, and between the side edge 63*a* of the middle member 63 and the side edge 61*a* of the outer member 61, and thus the inner member 62 and the middle member 63 may be slidable.

Figure 9:
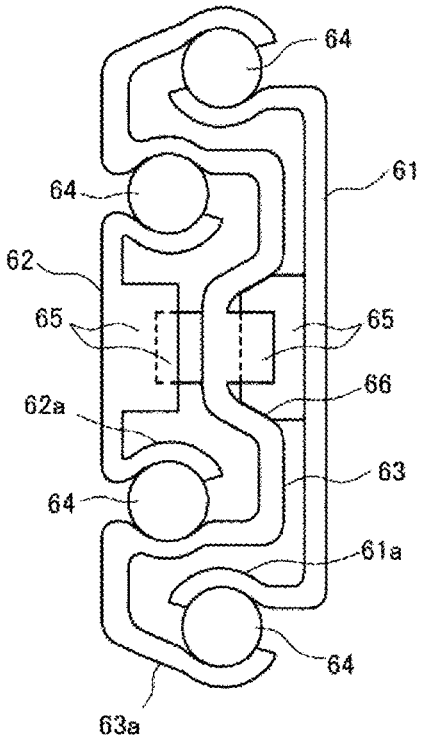
FIG. 9 illustrates a view of a modified embodiment of a slide rail according to one embodiment of the disclosure.

FIG. 9 illustrates a view of a modified embodiment of a slide rail.

As illustrated in FIG. 9, according to the modified embodiment, the outer member 61 and the inner member 62 are formed by being bent to have the general "U" shaped cross section in the same manner as one embodiment, and the middle member 63 is formed by being bent to have a general "W" shaped cross-section.

Side edges 61*a*, 62*a* and 63*a* extending in the longitudinal direction of the respective members 61, 62 and 63 are arranged such that the side edge 63*a* of the middle member 63, which is bent to have the general "V" shaped cross-section, is disposed outside the side edge 62*a* of the inner member 62 and the side edge 61*a* of the outer member 61 is disposed in a groove of the side edge 63*a* of the middle member 63.

Further, a ball 64 may be disposed between the side edge 62*a* of the inner member 62 and the side edge 63*a* of the middle member 63, and between the side edge 63*a* of the middle member 63 and the side edge 61*a* of the outer member 61, and thus the inner member 62 and the middle member 63 may be slidable.

The slide rail 60 may further include a stopper 65 preventing the respective members 61, 62, 63 from being separated from each other.

The stopper 65 is provided at both ends of the inner member 62 and the middle member 63, and is provided on one surface of the middle member 63 facing one surface of the inner member 62 and one surface of the inner member 62. The stoppers 65 provided in the inner member 62 and the middle member 63 are arranged such that the inner member 62 and the middle member 63 interfere with each other in a state in which the inner member 62 moves relative to the middle member 63 by a predetermined length.

Further, the stopper 65 is provided at both ends of the outer member 61 and the middle member 63, and is provided on one surface of the middle member 63 facing one surface of the outer member 61 and one surface of the outer member 61. The stoppers 65 provided in the outer member 61 and the middle member 63 are arranged such that the outer member 61 and the middle member 63 interfere with each other in a state in which the middle member 63 moves relative to the outer member 61 by a predetermined length.

The slide rail 60 may further include a guide groove 66 in which the stopper 65 is inserted and moved.

In the above embodiment, the first rail 40 and second rail 50 are connected via the slide rail having three members 61, 62 and 63, and thus the drawer 20 is taken out from the storage compartment R1 by two stages. However, the drawer 20 may be taken out from the storage compartment R1 by a single stage by using a single slide rail, or the drawer 20 may be taken out from the storage compartment R1 by three or more stages by using other type slide rails.

Figure 10:
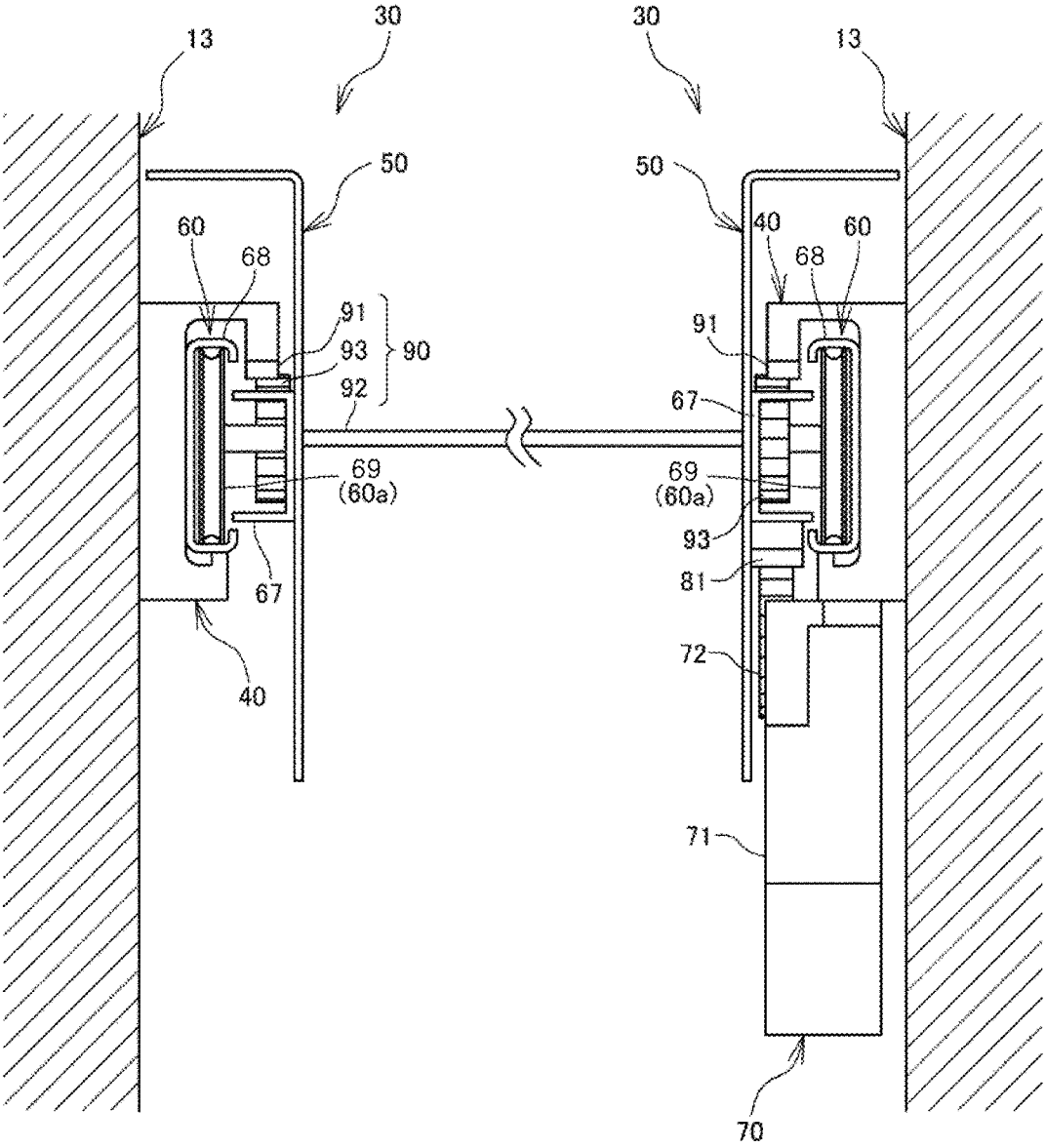
FIG. 10 illustrates a view of a modified embodiment of the sliding apparatus according to one embodiment of the disclosure.

FIG. 10 illustrates a view of a modified embodiment of the sliding apparatus.

As illustrated in FIG. 10, a slide rail 60 includes a guide rail 68 installed in a first rail 40, and a roller 69 rotatably installed in a second rail 50 and rolled along the guide rail 68. The roller 69 corresponds to the rolling mechanism 60*a*, and the rolling mechanism 60*a* is configured to facilitate the sliding movement of the second rail 50 against the first rail 40.

The guide rail 68 is a member that does not slide against the first rail 40 and the roller 69 is a member that does not slide against the second rail 50.

The second rail 50 is formed in a "L "shape by bending a long plate member along its longitudinal direction and is provided with an installation rail 67 configured to install a driving rack gear 81 on a surface facing the first rail 40.

A drive gear 72 of a drive unit 70 is configured to move in a direction of being in contact or separated from the driving rack gear 81 installed in the installation rail 67.

According to one embodiment, the adjustment gear 93 of the adjustment unit 90 is provided on the drawer 20 side, particularly, on the second rail 50 side, and the adjustment rack gear 91 is installed on the refrigerator body 10 side, particularly, the first rail 40 side, but is not limited thereto. Therefore, the opposite structure may be applicable. That is, the adjustment gear 93 may be provided on the refrigerator body 10 side and the adjustment rack gear 91 may be provided on the drawer 20 side.

Both adjustment gears 93 are coupled to the respective shafts 92 so as to be rotatable relative to the refrigerator body 10 and both adjustment rack gears 91 are installed to move with the drawer 20.

By increasing the strength of the portion where the adjustment gears 93 are provided, it is possible to omit the shaft 92 coupled to the both adjustment gears 93.

As is apparent from the above description, according to the proposed refrigerator, it is possible to constantly maintain the quality of the refrigerator since it is possible to be relatively easily assembled in the manufacturing of the refrigerator, and it is possible to reduce a load applied to a drive unit driving a rail although a position of the rail is displaced with respect to a refrigerator body due to the deterioration over time or the deterioration caused by the change in a weight of things in accordance with the increase or decrease in the amount of the things stored in a drawer.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:
a body;
a storage compartment disposed inside the body and including an opening;
a drawer configured to open and close the opening of the storage compartment; and
a sliding device configured to slidably support the drawer against the storage compartment, the sliding device comprising:
a first rail installed on an inner wall of the storage compartment,
a second rail installed on the drawer and configured to be slidable with respect to the first rail,
a drive unit installed on an end of the first rail adjacent to the opening and spaced apart from the inner wall of the storage compartment and configured to provide a driving force to slide the second rail through a drive gear of the drive unit, wherein a topmost surface of the drive unit is coupled to a lower surface of the first rail, and
a first rack gear slidably installed on the second rail and configured to engage with the drive gear, and
an elastic member disposed between the first rail and the second rail and configured to press the first rack gear against the drive gear.

2. The refrigerator of claim 1, wherein the sliding device further comprises a power transmission unit configured to transmit the driving force of the drive unit to the second rail.

3. The refrigerator of claim 2, wherein the drive unit comprises:
a housing comprising the topmost surface coupled to the lower surface of the first rail; and
a drive motor disposed inside the housing; and
wherein the drive gear is disposed outside the housing and configured to transmit the driving force of the drive motor to the power transmission unit.

4. The refrigerator of claim 3, wherein:
the first rail comprises a first end disposed in a front portion of the storage compartment adjacent to the opening and a second end disposed in a rear portion of the storage compartment, and
the drive gear is adjacent to the first end.

5. The refrigerator of claim 3, wherein the power transmission unit comprises the first rack gear.

6. The refrigerator of claim 5, wherein the power transmission unit comprises the elastic member.

7. The refrigerator of claim 5, wherein the first rack gear is coupled to the second rail to be relatively movable in a direction perpendicular to a direction in which the drawer opens and closes the opening of the storage compartment.

8. The refrigerator of claim 7, wherein:
the second rail comprises a plurality of holes elongated in a direction parallel to a direction in which the first rack gear moves relative to the second rail, and
the first rack gear comprises a plurality of screw members configured to pass through the plurality of holes and be movable along the plurality of holes.

9. The refrigerator of claim 8, wherein:
the plurality of holes comprises a first hole and a second hole, and
the first hole and the second hole include different lengths in the direction parallel to the direction the first rack gear moves relative to the second rail.

10. The refrigerator of claim 3, wherein:
the drive unit comprises a receiving portion recessed on an outer surface of the housing and configured to receive the drive gear therein; and
a cap coupled to the housing to cover at least one part of the receiving portion.

11. The refrigerator of claim 10, wherein the drive unit further comprises a discharging portion configured to communicate with the receiving portion and extend to a lower side from the receiving portion.

12. The refrigerator of claim 5, wherein the first rack gear is disposed above the drive gear.

13. The refrigerator of claim 1, wherein the sliding device further comprises an adjustment unit disposed in a rear side of a power transmission unit to adjust a moving distance of the second rail with respect to the first rail.

14. The refrigerator of claim 13, wherein the adjustment unit comprises:
a second rack gear installed on the first rail;
a shaft rotatably supported by the second rail; and
an adjustment gear provided on both ends of the shaft and configured to engage with the second rack gear.

15. The refrigerator of claim 14, wherein the second rack gear is disposed above the adjustment gear.

16. The refrigerator of claim 14, wherein the second rack gear is disposed to be opposite to the first rack gear with respect to the adjustment gear.

17. The refrigerator of claim 1, wherein the sliding device further comprises a slide rail disposed between the first rail and the second rail and configured to slide the second rail against the first rail.

18. The refrigerator of claim 5, wherein:

the storage compartment comprises a protruding portion formed such that a part of the inner wall of the storage compartment is protruded toward the opening, and the first rack gear is disposed above the protruding portion inside the storage compartment.

* * * * *